US005651635A

United States Patent [19]

Nagle

[11] Patent Number: 5,651,635

[45] Date of Patent: Jul. 29, 1997

[54] CONCRETE BARRIER WITH REINFORCEMENT

[75] Inventor: Gordon A. Nagle, West Brunswick Township, Schuylkill County, Pa.

[73] Assignee: Schuylkill Products, Inc., Cressona, Pa.

[21] Appl. No.: 427,426

[22] Filed: Apr. 24, 1995

[51] Int. Cl.[6] ..... E01F 13/00

[52] U.S. Cl. ..... 404/6; 404/12; 404/70; 256/13.1; 52/294; 52/633

[58] Field of Search ..... 404/6, 9; 256/1, 256/13.1; 52/294–299, 657, DIG. 7, 633

[56] References Cited

U.S. PATENT DOCUMENTS

| | | | |
|---|---|---|---|
| 3,732,653 | 5/1973 | Pickett | 52/71 |
| 3,794,433 | 2/1974 | Schupack | 404/1 |
| 4,105,353 | 8/1978 | Bórk et al. | 404/2 |
| 4,439,972 | 4/1984 | Tolliver | 52/651 |
| 4,467,583 | 8/1984 | Hasak | 52/653 |
| 4,605,336 | 8/1986 | Slaw | 404/6 |
| 4,642,964 | 2/1987 | Kellison | 52/699 |
| 4,954,009 | 9/1990 | Kellison | 404/6 |
| 5,119,614 | 6/1992 | Rex | 52/720 |
| 5,131,786 | 7/1992 | House et al. | 404/6 |
| 5,218,805 | 6/1993 | Rex | 52/295 |

OTHER PUBLICATIONS

Engr. Instruction, NY State Dept. of Transportation, Single–Slope Concrete Median Barrier, Aug. 4, 1993.

An Introduction To Prestressed Concrete, vol. 1, by Paul W. Abeles, pp. 250–255, Concrete Publications Limited, London, 1964.

Reinforced Concrete Fundamentals, Fifth Edition, by Phil M. Ferguson et al., pp. 154, 155 and 158–175, John Wiley & Sons, New York, 1988.

*Primary Examiner*—Henry A. Bennett
*Assistant Examiner*—Pamela A. O'Connor
*Attorney, Agent, or Firm*—Daniel A. Suollivan, Jr.

[57] ABSTRACT

A special reinforcement basket of steel rebar for reinforcing concrete barriers has toe regions of increased strength. Above the toe regions, there is a shoulder region where windows, or gaps, in the rebar provide for uninterrupted passage of holes in the concrete for anchor bolts, in order that the cast barrier may be anchored to a foundation. The invention is especially useful for precast concrete road barriers, which are manufacturered in a plant and then brought to a site and anchored in place.

22 Claims, 6 Drawing Sheets

REINFORCING BAR LIST FOR ONE 20' – LONG BARRIER

| MARK | QTY. | SIZE | LENGTH | TYPE | A | B | C | D | E | F | G | H |
|---|---|---|---|---|---|---|---|---|---|---|---|---|
| 34 | 2 | 5 | 5'–0" | STR. | | | | | | | | |
| 32 | 9 | 4 | 19'–8" | STR. | | | | | | | | |
| 30 | 22 | 5 | 9'–3" | 1 | 6 3/4" | 31" | 16" | 26" | 31 1/4" | | 14 7/8" | 3 7/8" |

1

REINFORCING BAR LIST FOR ONE 20' BARRIER

| MARK | QTY. | SIZE | LENGTH | TYPE | A | B | C | D | E | F |
|---|---|---|---|---|---|---|---|---|---|---|
| 48 | 22 | 5 | 7'-8 1/4" | 1 | 4 1/2" | 2'-6 1/2" | 1'-4 1/4" | 1'-9" | 1'-9" | 5 3/4" |
| 52 | 10 | 4 | 19'-8" | STR. | | | | | | |

CONCRETE BARRIER WITH REINFORCEMENT

TECHNICAL FIELD

The present invention relates to reinforcement for concrete barriers and to concrete barriers cast to contain such reinforcements.

BACKGROUND OF INVENTION

U.S. Pat. No. 4,954,009 of Kellison shows concrete barriers anchored to a road surface by bolts extending through holes in the barriers.

U.S. Pat. No. 4,605,336 of Slaw provides a precast concrete parapet that has reinforcing bars which run outside of the precast shape in order to pass around a locking bar for anchoring the parapet in place.

U.S. Pat. No. 5,131,786 of House et al. also has reinforcing rods extending outside of a precast concrete barrier for anchoring purposes. Otherwise, the precast concrete of House et al. is reinforced by welded wire fabric.

DISCLOSURE OF INVENTION

Objects of the invention include the provision of new reinforcement for concrete barriers and new concrete barriers containing those reinforcements. Particularly, it is an object of the invention to create a reinforcement which effectively cooperates with the concrete to transfer service loads placed on a concrete barrier, through the barrier and reinforcement, to anchor pockets of the barrier, where anchor bolts can then pass the loads to a foundation beneath the barrier.

Other objects of the invention will become apparent from the remainder of this specification as set forth below.

Cast concrete barriers, made, for example, of Portland cement and suitable aggregate, are used for many purposes, particularly for the purpose of separating or restraining vehicular traffic. The provision of these barriers as precast shapes is of special advantage, because it permits them to be manufactured in high quantity and quality in plants especially equipped for such purpose. While this invention is especially suited for use with precast concrete barriers, it is also useful for machine-formed barriers and cast-in-place barriers. "Machine formed" refers to a process of manufacturing concrete barriers by extrusion from a moving mold.

An example of the use of concrete barriers is as median barriers on a highway, for a principal purpose of reducing the danger of head-on collisions. Another example is as bridge parapets, to provide resistance against sideways deviation from bridges. The invention will be illustrated below with examples from both categories of barriers.

A characteristic of the present invention is provision of a special reinforcement basket of metal rods or reinforcing bar, termed "rebar" for short. The basket generally will be in the shape of the desired barrier but will have dimensions less than the barrier, so that when the concrete is cast to encompass the basket, the basket will lie spaced from the surface of the concrete. When the concrete hardens, the basket serves to reinforce the barrier.

A particular feature of the basket of the invention is that it has toe regions of increased strength. Above these toes, there is a shoulder region where windows, or gaps, in the rebar provide for uninterrupted passage of holes in the concrete for anchor bolts, in order that the cast barrier may be anchored to a foundation.

Other important characteristics of the invention will become apparent in the remaining explanations below.

BRIEF DESCRIPTION OF THE DRAWINGS

In the Figures, like features bear the same numerals.

MODES OF THE INVENTION

Figure 1:
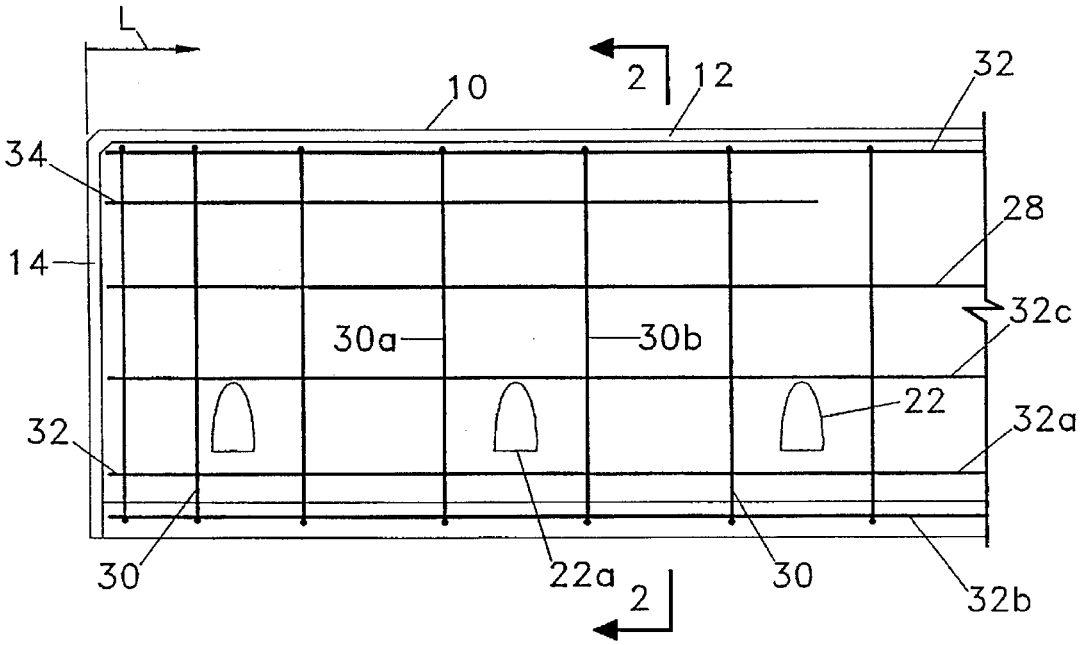
FIG. 1 is a front, partially cut away, view of a reinforced concrete barrier of the invention. Internal reinforcing bar is shown by heavy dark lines, according to custom in the field of reinforced concrete. Only the bars adjoining the front surface are shown in this Fig.
Figure 2:
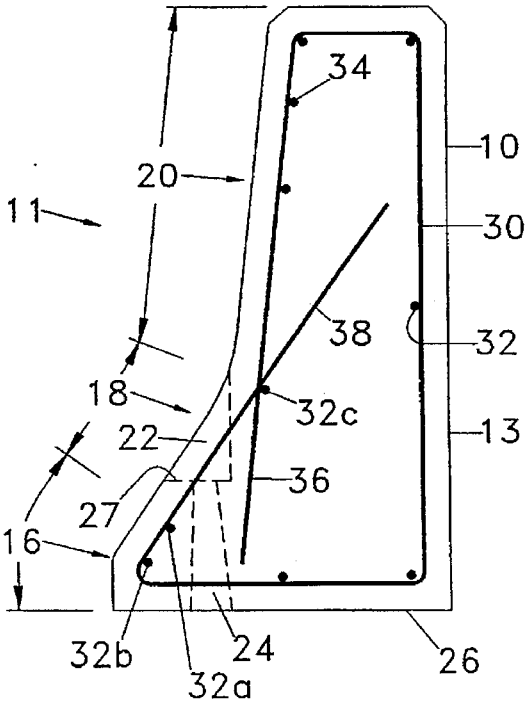
FIG. 2 is a cross sectional view according to cutting plane 2—2 of FIG. 1, i.e. a cutting plane perpendicular to the length direction of the barrier. Internal reinforcing bar is shown by heavy dark lines and dots, again according to custom in the field of reinforced concrete. This Fig. shows the bars at the back and bottom surfaces of the barrier, in addition to those shown in FIG. 1 at the front surface.
Figure 3:
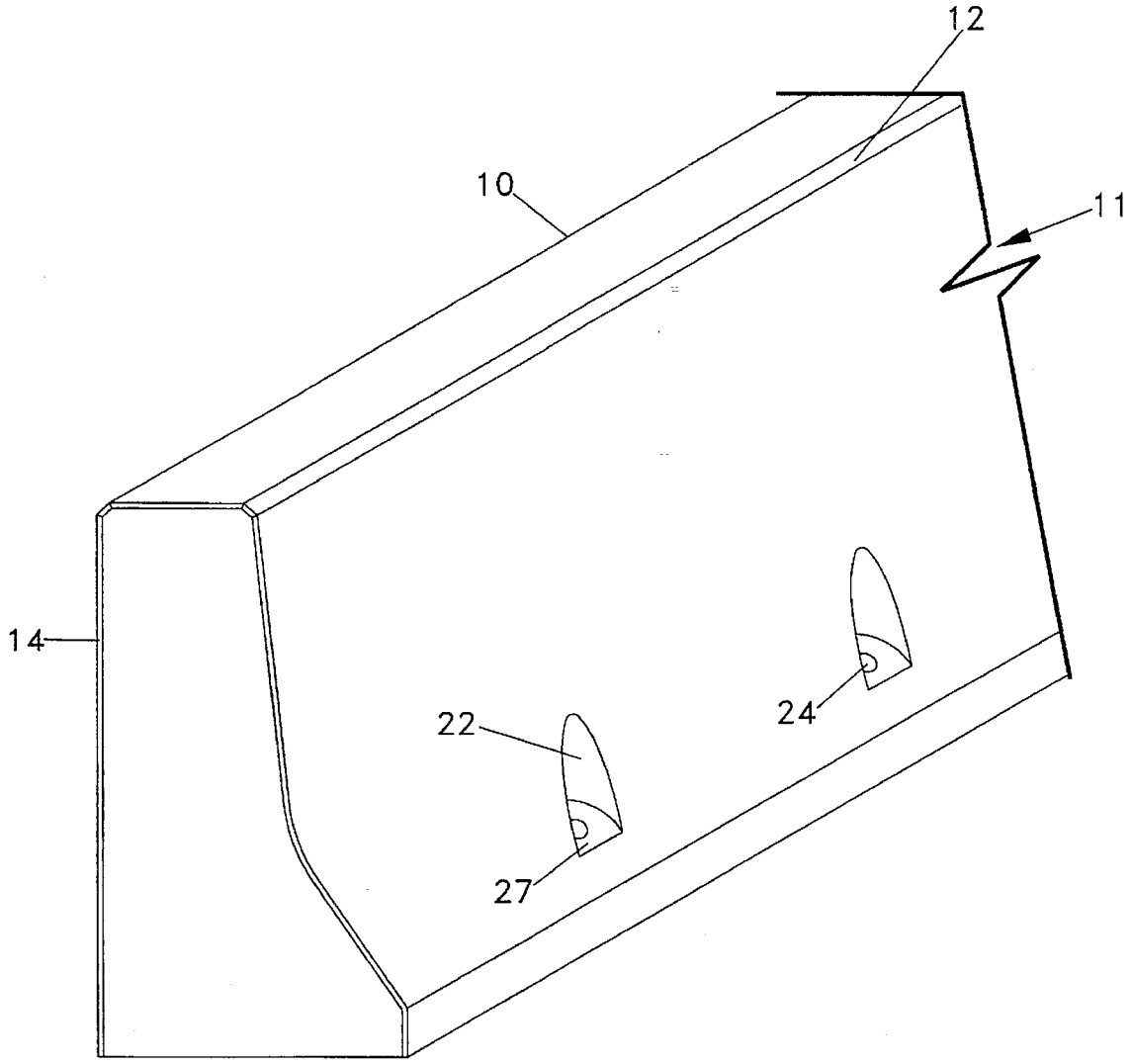
FIG. 3 is an oblique drawing of the barrier of FIGS. 1 and 2, showing the end at the left of FIG. 1 the front as seen in FIG. 1 and the top of the barrier.

FIGS. 1–3 illustrate principles of the invention on the basis of a barrier in the form of a precast reinforced concrete bridge parapet 10. The parapet has an elongated shape, and thus a length direction as shown by arrow L. On its front, or traffic, side 11, i.e. the left side in FIG. 2, there are variously sloped surfaces which cause its cross section to be recognized by those skilled in the art as an example of the so-called New Jersey barrier. If parapet 10 were, instead, a median barrier, the sloped surfaces of the New Jersey barrier would be replicated on the back side 13 (right side in FIG. 2) of the barrier as well.

Parapet 10 has chamfers 12 and 14 on the top and end edges, respectively, as shown particularly in FIG. 3. Instead of chamfers, the edges may be rounded with a suitable radius.

Elevationally, as shown in FIG. 2, parapet 10 is divided into three regions, toe 16, shoulder 18 and head 20. The demarcations between these regions is based on the presence of certain structural features. The toe is a region of substantial rebar reinforcement and is shaped like a toe in that it protrudes out from the rest of the structure. The shoulder contains the anchor pockets 22. The head is the portion above the anchor pockets.

Each of the anchor pockets contains a bolt hole 24 extending from the shoulder region 18 to the floor 26 of the parapet. Toe 16 lies outboard of holes 24. When the parapet is put into use, an anchor system is used in the anchor pockets and holes, to bolt the parapet to a bridge deck or other foundation. An example of a suitable anchor system is the anchor system 34 of the above-referenced U.S. Pat. No.

4,954,009. U.S. Pat. Nos. 4,954,009 and 4,642,964 of Kellison are incorporated by reference. Instead of the plate or washer 35 of U.S. Pat. No. 4,954,009, it may be advantageous to embed in the floors 27 of the pockets a rectangular washer, like that shown in FIG. 5 of U.S. Pat. No. 5,218,805, which has a special slot for introduction of bonding resin or grout. U.S. Pat. No. 5,218,805 of Rex is incorporated by reference.

The reinforcement of the invention is illustrated in the drawings by heavy black lines, according to convention in the field of reinforced concrete. This technique of illustration allows one to visualize the spatial relation of the reinforcement to the cast concrete which encompasses it.

The reinforcement forms a three-dimensional basket 28. As a general rule, the individual rebar pieces of the basket are always located, for instance, at least two inches inwards from the surface of the concrete, in order, for instance, to provide protection for the steel material of the rebar from exposure to environmental oxidation. The steel may also be guarded against rusting by a protective coating, for example, an epoxy coating. The e.g. two-inch spacing all around means that basket 28 has the same basic shape as the parapet; thus, basket 28, like parapet 10, also has a direction of elongation, which is the same as the length direction L of the parapet.

Basket 28 is composed of rebar stirrups 30 and rebar stringers 32, 34. At points where the stirrups and stringers are next to one another, they are preferably joined by tie wires or welds (neither of these measures is shown in the drawings). All of the stringers are nominally ("nominally", because of the two-inch spacing all around) full length stringers, extending from one end of the parapet to the other. These are labeled as stringers 32. The exception is stringer 34, and its mirror image at the other end of the parapet (not shown), which are limited in length at the two ends of the parapet for additional end reinforcement. The stringers extend across the stirrups, within the stirrups.

As shown particularly in FIG. 2, each stirrup 30 follows generally the outline of the parapet, except that the ends 36 and 38 have been extended to intersect and form an "X" where the shoulder region 18 borders with the head region 20. The extension of end 36 is such that it lies inboard of hole 24. Since the stirrups follow the outline of the parapet, the stirrups have the so-called New Jersey shape too, and the stirrups, and the basket, have toe, shoulder, and head regions corresponding to those regions in the parapet.

FIG. 1 shows that the stirrups are, in general, spaced uniformly from one another, facing one another, along the length direction L of the barrier, except for a progressively closer spacing at the two ends of the barrier (only one end of the barrier is shown in FIG. 1, the other end being a mirror image of the shown left end). In the illustrated embodiment, the normals (not shown) to the planes of the stirrups are parallel to direction L, but other stirrup attitudes may be of advantage, for instance zigzag placements, or various tilted arrangements.

Of the full length stringers 32, the two stringers 32*a* and *b* provide extra strength in the toe region. Stringer 32*c* is located at the X-intersection.

There are certain special relationships in the positioning of the members of the reinforcement basket 28 relative to the anchor pockets 22 and holes 24. Thus, for example, there are windows in the shoulder region of the basket for the locating of the pockets and holes. Taking pocket 22*a* of FIG. 1, for example, a window, or absence of rebars, exists for the pocket and its hole, the window being framed by stringers 32*a–c* and stirrups 30*a* and *b*. On the basis of the two stringers 32*a* and *b*, the window is framed with greater strength toward the toe region then in the head and shoulder regions. Focussing on the holes 24, the stringers extend crosswise to the holes, and the stirrups are located between the holes.

Figure 4:
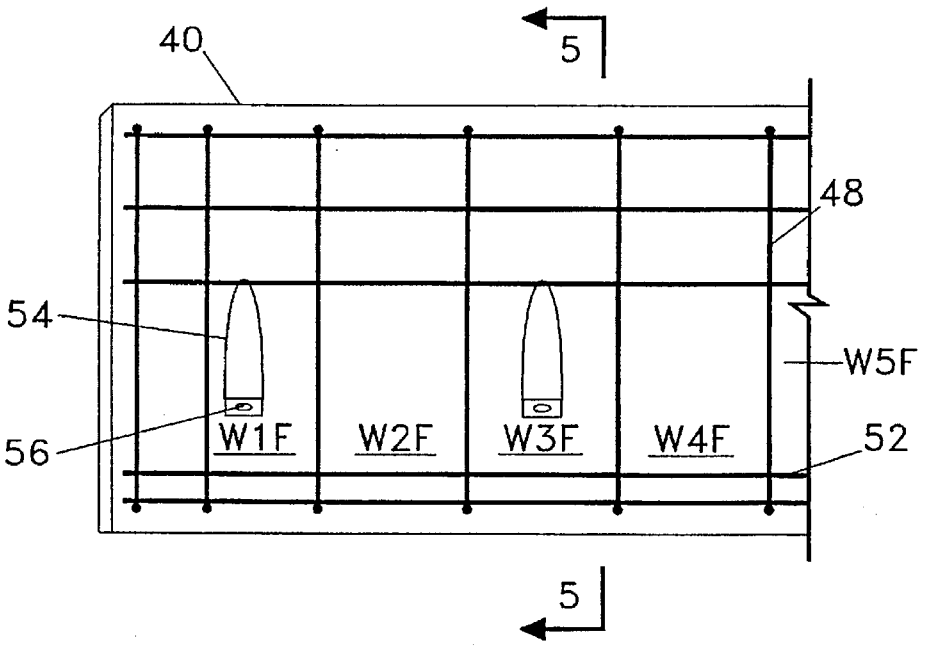
FIG. 4 is a front, partially cut away, view of another reinforced concrete barrier of the invention, showing, as in FIG. 1, internal reinforcing bar.
Figure 5:
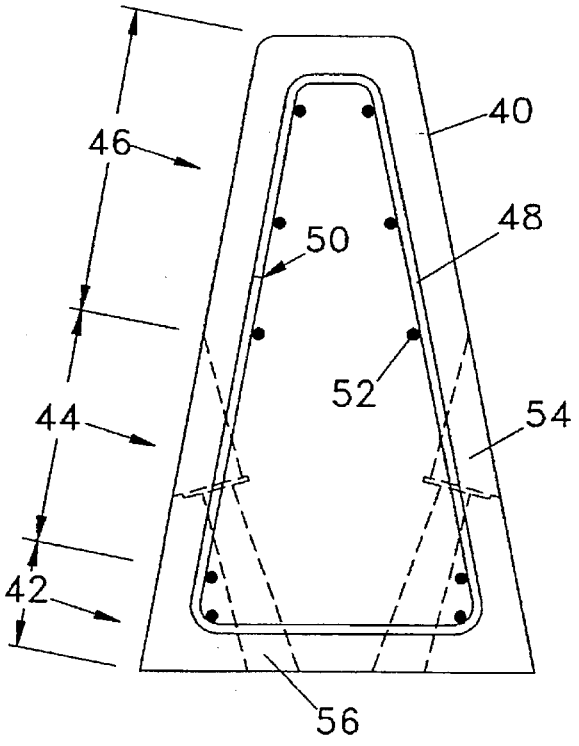
FIG. 5 is a cross sectional view according to cutting plane 5—5 of FIG. 4, i.e. a cutting plane perpendicular to the length direction of the barrier. Internal reinforcing bar is shown as in FIG. 2.
Figure 6:
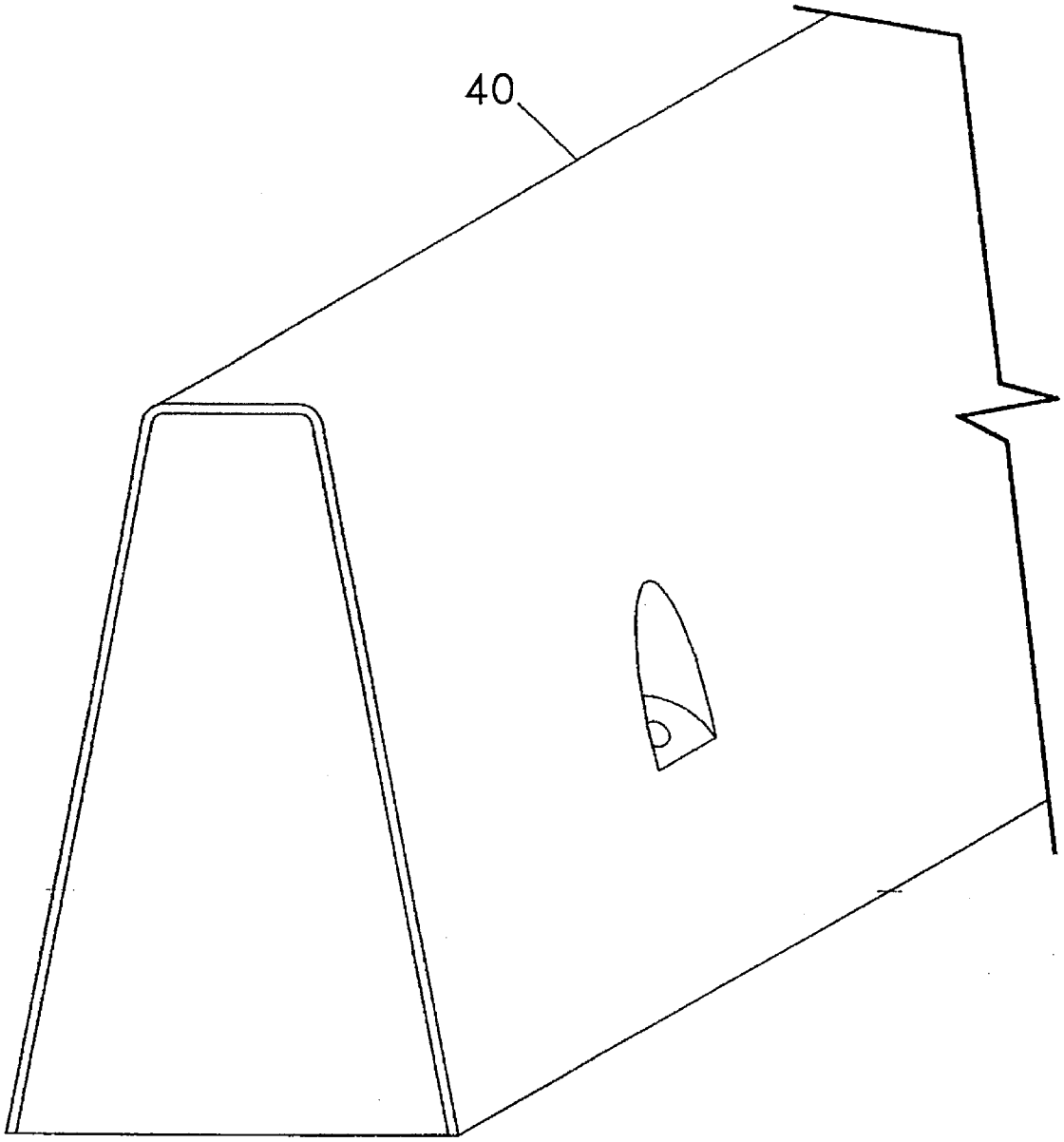
FIG. 6 is an oblique drawing of the barrier of FIGS. 4 and 5, showing the end at the left of FIG. 4, the front as seen in FIG. 4, and the top of the barrier.

Referring now to FIGS. 4–6, these depict a precast concrete median barrier 40. This barrier is a member of a class of barriers referred to as "single-slope" barriers, in that it has a trapezoidal cross section (FIG. 5) whose sides have the same slope, except that one slope is negative and the other positive.

Many aspects of this barrier are similar to those of the parapet of FIGS. 1–3, so the focus in the description of this barrier will be on differences in this barrier as compared to that of the parapet.

Here, the toe, shoulder, and head regions 42, 44 and 46 are defined in an analogous manner to that used for the parapet. They are shown in FIG. 5. In contrast to the situation for the parapet of FIGS. 1–3, there is a toe on either side of the cross section in FIG. 5.

The rebar of stirrups 48 are butt welded closed at weld 50, or a lap joint may be used as shown below in the example.

All of stringers 52 are nominally full length stringers.

This being a median barrier, there are anchor pockets 54 and holes 56 on both the front and the back of the barrier. The holes 56 slant back from the toe, to miss the stringers in the toe.

Preferably, an alternation is used in the placement of the pockets and holes in windows on the front versus the back of the barrier. Thus, with reference to FIG. 4, pockets 54 and holes 56 are in windows W1F, W3F, W5F, etc., on the front of the barrier, while on the back, pockets 54 and holes 56 are in windows W1B, W2B, W4B, etc., where the "F" in the reference labels indicates windows on the front of the barrier, and the "B" refers to windows (not shown) on the back, opposite to their correspondingly numerically indexed windows on the front. In this scenario, in a 20-foot long barrier in which the central stirrups are spaced uniformly from one another at one-foot intervals, there will be 10 pockets and holes on the front and 11 pockets and holes on the back, this so that the first windows on the ends, i.e. windows W1F and W1B on the left end, and windows W19F and W19B on the right end (not shown) will always have anchor bolts.

Further illustrative of the invention are the following Examples 1 and 2:

EXAMPLE 1

Figure 7:
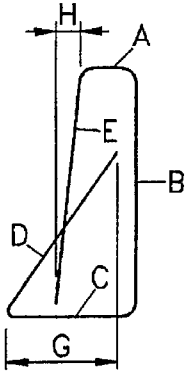
FIGS. 7 and 8 are tabular presentations for examples of the invention.

FIG. 7 is an example for a the parapet of FIGS. 1–3. The entries in the column "MARK" reference, respectively, stringers 34, stringers 32, and stirrups 30. The designations in the column "SIZE" are on the basis of ASTM Standard No. A615. In the column "TYPE", "STR." means "straight", and "1" is reference to the table's sketch circled-1, which shows the correspondence between the dimensions in the columns A–H and the segments of the stirrup. The barrier was cast to encompass a basket constructed from the listed rebar with concrete formulated to have a minimum strength of 5000 psi with 5½% to 9% by volume air content.

EXAMPLE 2

Figure 8:
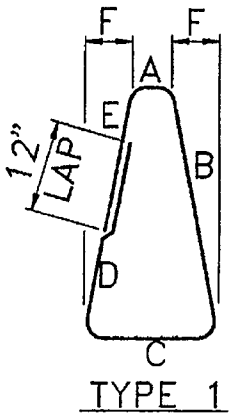

FIG. 8 is an example of a median barrier mainly following FIGS. 4–6, but containing stirrups modified to utilize an overlap rather than a butt weld. Column entries, etc., are otherwise to be interpreted as in Example 1.

There follows, now, the claims. It is to be understood that the above are merely preferred modes of carrying out the invention and that various changes and alterations can be made without departing from the spirit and broader aspects of the invention as defined by the claims set forth below and by the range of equivalency allowed by law.

What is claimed is:

1. A reinforcement for reinforcing an elongated concrete traffic barrier, the reinforcement comprising, in an elongated concrete traffic barrier:

stirrups spaced from one another and facing one another along a length direction, and stringers distributed around the stirrups, each stringer extending between and across a plurality of stirrups, the stirrups each having a toe, there being a plurality of said stringers in the toe of each stirrup.

2. A reinforcement as claimed in claim 1, the stirrups having a single-slope cross section, the stirrups each having a shoulder region above the toe, and a head region above the shoulder region, a group of said stringers being spaced around the head region, the shoulder region representing a gap in the distribution of stringers around the stirrups.

3. A reinforcement as claimed in claim 1, the stirrups having a cross section which has a plurality of slopes, the stirrups each having a shoulder region above the toe, and a head region above the shoulder region, the stirrups having ends intersecting to form an X-intersection, and thus having an X-intersection, where the shoulder region borders with the head region.

4. A reinforcement as claimed in claim 3, with one of said stringers being located at the X-intersection.

5. A reinforcement basket of metal rods, for reinforcement of a concrete traffic barrier, which basket comprises, in a concrete traffic barrier:

a head region of rods, a shoulder region of rods below the head region, and a toe region of rods below the shoulder region, there being windows in the shoulder region, the windows being framed with greater strength toward the toe region than in the head and shoulder regions.

6. A basket as claimed in claim 5, having a direction of elongation, the regions being defined in a cross section perpendicular to the direction of elongation.

7. A basket as claimed in claim 6, said cross section being a single-slope cross section.

8. A basket as claimed in claim 6, said cross section being a cross section which has a plurality of slopes, rod ends intersecting to form an X-intersection, and thus having an X-intersection, where the shoulder region borders with the head region.

9. A basket as claimed in claim 8, with a stringer rod extending in the direction of elongation at the X-intersection.

10. A concrete traffic barrier, the barrier having a length direction, along which the barrier has its greatest dimension, the barrier having a sequence of at least three anchor bolt holes arranged spaced from one another in the length direction, the anchor bolt holes extending from an inclined shoulder region to a floor, a toe outboard of the holes, and rebar in the toe.

11. A barrier as claimed in claim 10, the rebar extending crosswise to the holes.

12. A barrier as claimed in claim 11, further containing metal stirrups located between the holes.

13. A barrier as claimed in claim 12, the rebar extending across the stirrups, within the stirrups.

14. A barrier as claimed in claim 13, having a single-slope cross section, the holes slanting back from the toe, to miss the rebar.

15. A barrier as claimed in claim 13, having a cross section which has a plurality of slopes, and an end of the stirrups lying inboard of the holes.

16. A concrete traffic barrier, the barrier having a length direction, along which the barrier has its greatest dimension, the barrier having a sequence of at least three anchor bolt holes arranged spaced from one another in the length direction, the anchor bolt holes extending from an inclined shoulder region to a floor, a toe outboard of the holes, and metal reinforcing stringers extending in the length direction in the toe.

17. A barrier as claimed in claim 16, the stringers extending crosswise to the holes.

18. A barrier as claimed in claim 17, further containing metal stirrups located between the holes.

19. A barrier as claimed in claim 18, the stringers extending across the stirrups, within the stirrups.

20. A barrier as claimed in claim 19, having a single-slope cross section, the holes slanting back from the toe, to miss the stringers.

21. A barrier as claimed in claim 19, having a cross section which has a plurality of slopes, and an end of the stirrups lying inboard of the holes.

22. A barrier as claimed in claim 19, the anchor bolt holes being situated in windows framed by reinforcement comprised of the stirrups and stringers, the windows being framed with greatest strength in said toe.

* * * * *